US008791867B2

(12) United States Patent
Joo

(10) Patent No.: US 8,791,867 B2
(45) Date of Patent: Jul. 29, 2014

(54) ANTENNA DEVICE AND MOBILE TERMINAL HAVING THE SAME

(75) Inventor: Wonseok Joo, Seoul (KR)

(73) Assignee: LG Electronics Inc., Seoul (KR)

( * ) Notice: Subject to any disclaimer, the term of this patent is extended or adjusted under 35 U.S.C. 154(b) by 219 days.

(21) Appl. No.: 13/527,806

(22) Filed: Jun. 20, 2012

(65) Prior Publication Data

US 2013/0016028 A1 Jan. 17, 2013

(30) Foreign Application Priority Data

Jul. 13, 2011 (KR) ..... 10-2011-0069611

(51) Int. Cl.
*H01Q 1/24* (2006.01)

(52) U.S. Cl.
USPC ..... 343/702

(58) Field of Classification Search
USPC ..... 343/702, 883, 901, 906
See application file for complete search history.

(56) References Cited

U.S. PATENT DOCUMENTS

| | | | | |
|---|---|---|---|---|
| 5,835,071 | A * | 11/1998 | Phelps | 343/906 |
| 6,225,953 | B1 * | 5/2001 | Kamei et al. | 343/702 |
| 6,380,900 | B1 * | 4/2002 | Kanayama | 343/702 |
| 7,081,855 | B2 * | 7/2006 | Murray et al. | 343/702 |
| 7,301,501 | B2 * | 11/2007 | De Vos et al. | 343/702 |

* cited by examiner

*Primary Examiner* — Tho G Phan
(74) *Attorney, Agent, or Firm* — Ked & Associates, LLP

(57) ABSTRACT

A mobile terminal includes a terminal body, and an antenna device mounted in the terminal body. The antenna device includes an antenna unit having a housing extending in one direction, and a plurality of conductors sequentially retracted into the housing, an elastic unit having a hollow portion through which the housing moves, the elastic unit applying an elastic force to the housing, a post unit having a connecting portion connected with the antenna unit, and a stopping portion stopped at the elastic unit when being inserted into the hollow portion, and an insertion guiding unit formed at an outer circumferential surface of the post unit so that at least part of the post unit is inserted into the hollow portion before the stopping portion is stopped at the elastic unit in the one direction.

20 Claims, 11 Drawing Sheets

ANTENNA DEVICE AND MOBILE TERMINAL HAVING THE SAME

CROSS-REFERENCE TO RELATED APPLICATION

Pursuant to 35 U.S.C. §119(a), this application claims the benefit of earlier filing date and right of priority to Korean Application No. 10-2011-0069611, filed on Jul. 13, 2011, the contents of which is incorporated by reference herein in its entirety.

BACKGROUND OF THE INVENTION

1. Field of the Invention

This specification relates to an antenna device for transmitting and receiving wireless (radio) signals, and a mobile terminal having the same.

2. Background of the Invention

Terminals may be divided into mobile/portable terminals and stationary terminals according to their mobility. Also, the mobile terminals may be categorized into a handheld terminal and a vehicle mount terminal according to whether it is directly portable by a user.

As it becomes multifunctional, the mobile terminal can be allowed to capture still images or moving images, play music or video files, play games, receive broadcast and the like, so as to be implemented as a multimedia player.

Various new attempts have been made for the multimedia devices by hardware or software in order to implement such complicated functions. For example, a user interface environment is provided in order for users to easily and conveniently retrieve or select functions.

Furthermore, because a mobile terminal is considered as a personal belonging for expressing one's own personality, various design forms are required. The design forms include structural changes and improvements for the user to more conveniently use the mobile terminal.

An antenna may be considered as one of the structural changes and improvements.

SUMMARY OF THE INVENTION

Therefore, an aspect of the detailed description is to improve operation reliability of an antenna unit which is extendible from a mobile terminal.

Another aspect of the detailed description is to provide a mobile terminal having a diameter-increasing antenna unit (an antenna unit whose diameter gradually increases as being extended) stably secured therewith.

To achieve these and other advantages and in accordance with the purpose of this specification, as embodied and broadly described herein, there is provided a mobile terminal including a terminal body, and an antenna device, wherein the antenna device includes an antenna unit having a housing extending in one direction, and a plurality of conductors sequentially retracted into the housing, an elastic unit having a hollow portion through which the housing moves, the elastic unit applying an elastic force to the housing, a post unit having a connecting portion connected with the antenna unit, and a stopping portion stopped at the elastic unit when being inserted into the hollow portion, and an insertion guiding unit formed at an outer circumferential surface of the post unit so that at least part of the post unit is inserted into the hollow portion before the stopping portion is stopped at the elastic unit in the one direction.

In one aspect of the present disclosure, the post unit may move between a first position where the housing is received in the hollow portion and a second position where the stopping portion is stopped at the elastic unit.

The insertion guiding unit may form a gap between the post unit and the elastic unit such that at least part of the post unit can be inserted into the hollow portion between the first and second positions. The elastic unit may apply an elastic force to the post unit while the at least part of the post unit is inserted in the hollow portion. When the housing is pulled out, the conductors may be unfolded out of the terminal body while the elastic unit applies the elastic force to the post unit.

When the housing is pulled out from the first position, the antenna unit may be extended with the plurality of conductors being retracted in the housing.

In another aspect of the present disclosure, when the housing is pulled out, the at least part of the post unit may be moved out of the hollow portion while being inserted in the hollow portion.

In another aspect of the present disclosure, the plurality of conductors may include a connection conductor received in the housing and connected to the post unit, and intermediate conductors arranged between the connection conductor and the housing in an overlapping manner.

In another aspect of the present disclosure, the elastic unit may include a ring spring to press an outer circumference of the housing, and a coupling portion to support the ring spring and coupled to the terminal body.

The ring spring may be provided with a circumferential protrusion protruding toward the post unit, and a stepped portion may be formed at an outer circumferential surface of the post unit, so as to be stopped at the circumferential protrusion due to a reduction of a diameter of the post unit. The stopping portion may restrict a movement of the post unit in an opposite direction to the stepped portion restricting the movement of the post unit.

The elastic unit may further include an auxiliary ring spring to cover an outer circumference of the ring spring so as to increase an elastic force of the elastic unit. The coupling portion may extend from one of the ring spring and the auxiliary ring spring, or extend from a casing for covering the ring spring and the auxiliary ring spring.

In another aspect of the present disclosure, the insertion guiding unit may guide the post unit to be inserted into the elastic unit while the housing supports the elastic unit, by virtue of a structure that the post unit has a diameter smaller than that of the housing.

The insertion guiding unit may include a tilt portion inclined at one end of the post unit to gradually increase a contact between the post unit and the elastic unit. A housing protrusion may be formed at an end of the housing so as to increase a diameter of a portion of the elastic unit, adjacent to an opening of the hollow portion, when at least part of the elastic unit escapes out of the housing.

In another aspect of the present disclosure, the coupling portion and the stopping portion may be arranged at both ends of the post unit, and the coupling portion may be connected by a hinge to a conductor having the smallest diameter of the plurality of conductors.

In accordance with another exemplary embodiment of the present disclosure, there is provided a mobile terminal including a terminal body, and an antenna device mounted in the terminal body to transmit and receive a wireless signal, wherein the antenna device includes an antenna unit having a housing extending in one direction, and a plurality of hollow conductors retracted in the housing in an overlapping manner or extending out of the housing, an elastic unit mounted onto the terminal body and configured to apply an elastic force to the housing, and a post unit connected to one of the conductors to be movable together with the housing, the post unit being secured by being pressed by the elastic unit when the conductors are extended, wherein the post unit is configured such that at least part thereof is inserted into the elastic unit before the housing escapes from the elastic unit, a frictional force between the post unit and the elastic unit being greater than that between the conductors.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of an antenna device and a mobile terminal having the same according to the exemplary embodiments, with reference to the accompanying drawings. For the sake of brief description with reference to the drawings, the same or equivalent components will be provided with the same reference numbers, and description thereof will not be repeated. A singular representation may include a plural representation as far as it represents a definitely different meaning from the context.

A suffix "module" or "unit" used for constituent elements disclosed in the following description is merely intended for easy description of the specification, and the suffix itself does not give any special meaning or function.

A mobile terminal disclosed herein may include a portable phone, a smart phone, a laptop computer, a digital broadcast terminal, a personal digital assistant (PDA), a portable multimedia player (PMP), a navigator, and the like. However, it may be easily understood by those skilled in the art that the configuration according to the exemplary embodiments of this specification can be applied to stationary terminals such as digital TV, desktop computers and the like excluding a case of being applicable only to the mobile terminals.

Figure 1:
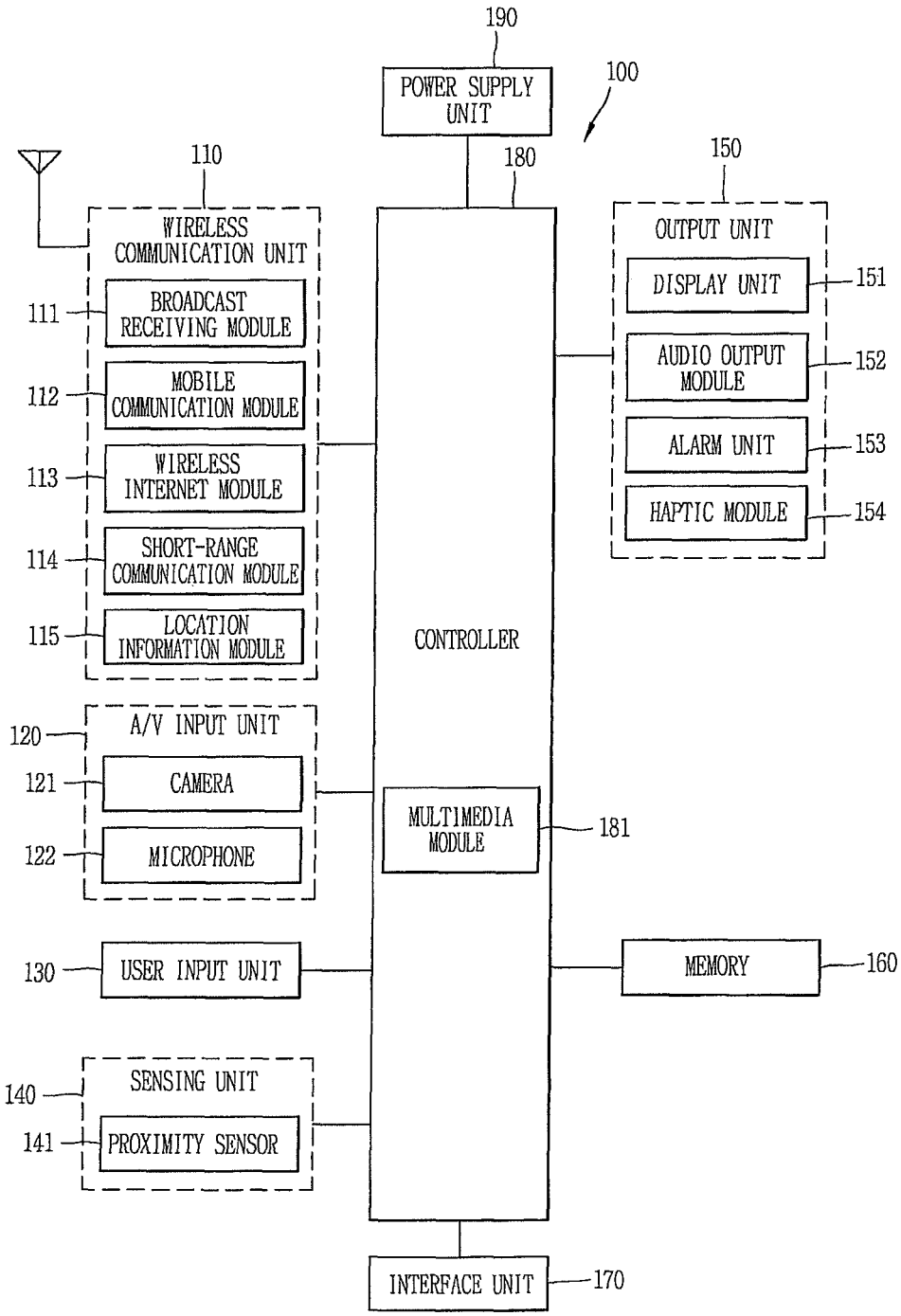
FIG. 1 is a block diagram illustrating a mobile terminal associated with an exemplary embodiment of the present disclosure.

FIG. 1 is a block diagram illustrating a mobile terminal associated with an exemplary embodiment.

The mobile terminal 100 may include a wireless communication unit 110, an Audio/Video (A/V) input unit 120, a user input unit 130, a sensing unit 140, an output unit 150, a memory 160, an interface unit 170, a controller 180, a power supply unit 190, and the like. However, all of the elements as illustrated in FIG. 1 are not necessarily required, and the mobile terminal may be implemented with greater or less number of elements than those illustrated elements.

Hereinafter, the constituent elements will be described in turn.

The wireless communication unit 110 typically includes one or more elements allowing radio communication between the mobile terminal 100 and a wireless communication system, or allowing radio communication between the mobile terminal 100 and a network in which the mobile terminal 100 is located. For example, the wireless communication unit 110 may include a broadcast receiving module 111, a mobile communication module 112, a wireless Internet module 113, a short-range communication module 114, a location information module 115, and the like.

The broadcast receiving module 111 receives broadcast signals and/or broadcast associated information from an external broadcast management server through a broadcast channel.

The broadcast channel may include a satellite channel and/or a terrestrial channel. The broadcast management server may mean a server that generates and transmits a broadcast signal and/or broadcast associated information or a server that receives a previously generated broadcast signal and/or broadcast associated information and transmits to the mobile terminal 100. The broadcast signal may include a TV broadcast signal, a radio broadcast signal and a data broadcast signal as well as a broadcast signal in a form that a data broadcast signal is coupled to the TV or radio broadcast signal.

The broadcast associated information may mean information regarding a broadcast channel, a broadcast program, a broadcast service provider, and the like. The broadcast associated information may also be provided through a mobile communication network, and in this case, the broadcast associated information may be received by the mobile communication module 112.

The broadcast associated information may exist in various forms. For example, it may exist in the form of an electronic program guide (EPG) of digital multimedia broadcasting (DMB), electronic service guide (ESG) of digital video broadcast-handheld (DVB-H), and the like.

The broadcast receiving module 111 may receive a broadcast signal using various types of broadcast systems. In particular, the broadcast receiving module 111 may receive a digital broadcast signal using a digital broadcast system such as digital multimedia broadcasting-terrestrial (DMB-T), digital multimedia broadcasting-satellite (DMB-S), media forward link only (MediaFLO), digital video broadcast-handheld (DVB-H), integrated services digital broadcast-terrestrial (ISDB-T), and the like. The broadcast receiving module 111 is, of course, configured to be suitable for every broadcast system that provides a broadcast signal as well as the above-mentioned digital broadcast systems.

Broadcast signals and/or broadcast associated information received via the broadcast receiving module 111 may be stored in a suitable device, such as a memory 160.

The mobile communication module 112 transmits and/or receives a radio signal to and/or from at least one of a base station, an external terminal and a server over a mobile communication network. In this exemplary embodiment, the radio signal may include a voice call signal, a video call signal and/or various types of data according to text and/or multimedia message transmission and/or reception.

The wireless Internet module 113 is a module for supporting wireless Internet access. The wireless Internet module 113 may be built-in or externally installed to the mobile terminal 100. In this exemplary embodiment, the wireless Internet module 113 may use a wireless Internet access technique including a Wireless LAN (WLAN), Wi-Fi, Wireless Broadband (Wibro), World Interoperability for Microwave Access (Wimax), High Speed Downlink Packet Access (HSDPA), and the like.

The short-range communication module 114 is a module for supporting a short-range communication. In this exemplary embodiment, it may be used a short-range communication technology including Bluetooth, Radio Frequency IDentification (RFID), Infrared Data Association (IrDA), Ultra WideBand (UWB), ZigBee, and the like.

The location information module 115 is a module for checking or acquiring a location of the mobile terminal, such as a GPS module.

Referring to FIG. 1, the A/V input unit 120 receives an audio or video signal, and the A/V input unit 120 may include a camera 121 and a microphone 122. The camera 121 processes an image frame, such as still picture or video, obtained by an image sensor in a video phone call or image capturing mode. The processed image frame may be displayed on a display unit 151.

The image frames processed by the camera 121 may be stored in the memory 160 or transmitted to an external device through the wireless communication unit 110. Two or more cameras 121 may be provided according to the use environment of the mobile terminal.

The microphone 122 receives an external audio signal through a microphone in a phone call mode, a recording mode, a voice recognition mode, and the like, and processes the audio signal into electrical voice data. The processed voice data may be converted and outputted into a format that is transmittable to a mobile communication base station through the mobile communication module 112 in the phone call mode. The microphone 122 may implement various types of noise canceling algorithms to cancel noise generated in a procedure of receiving the external audio signal.

The user input unit 130 may generate input data to control an operation of the terminal. The user input unit 130 may be configured by including a keypad, a dome switch, a touch pad (pressure/capacitance), a jog wheel, a jog switch, and the like.

The sensing unit 140 detects a current status of the mobile terminal 100 such as an opened or closed state of the mobile terminal 100, a location of the mobile terminal 100, existence or non-existence of a user contact, an orientation of the mobile terminal 100 and the like, and generates a sensing signal for controlling the operation of the mobile terminal 100. For example, when the mobile terminal 100 is a slide phone type, it may sense an opened or closed state of the slide phone. Furthermore, the sensing unit 140 takes charge of a sensing function associated with whether or not power is supplied from the power supply unit 190, or whether or not an external device is coupled to the interface unit 170. On the other hand, the sensing unit 140 may include a proximity sensor 141.

The output unit 150 is configured to provide an output for audio signal, video signal, or alarm signal, and the output unit 150 may include the display unit 151, an audio output module 152, an alarm unit 153, a haptic module 154, and the like.

The display unit 151 may display (output) information processed in the mobile terminal 100. For example, when the mobile terminal 100 is in a phone call mode, the display unit 151 may display a User Interface (UI) or a Graphic User Interface (GUI) associated with a call. When the mobile terminal 100 is in a video call mode or image capturing mode, the display unit 151 may display a captured image and/or received image, a UI or GUI.

The display unit 151 may include at least one of a Liquid Crystal Display (LCD), a Thin Film Transistor-LCD (TFT-LCD), an Organic Light Emitting Diode (OLED) display, a flexible display, and a three-dimensional (3D) display.

Some of those displays may be configured with a transparent or optical transparent type to allow viewing of the exterior through the display unit, and such displays may be called transparent displays. An example of a typical transparent display may include a transparent LCD (TOLED), and the like. Under this configuration, a user can view an object positioned at a rear side of a terminal body through a region occupied by the display unit 151 of the terminal body.

The display unit 151 may be implemented in two or more in number according to a configured aspect of the portable terminal 100. For instance, a plurality of the display units 151 may be arranged on one surface to be spaced apart from or integrated with each other, or may be arranged on different surfaces.

In embodiments where the display unit 151 and a touch sensitive sensor (referred to as a touch sensor) have an interlayer structure, the structure may be referred to as a touch screen. The display unit 151 may be used as an input device in addition to being used as an output device. The touch sensor may be implemented as a touch film, a touch sheet, a touch pad, and the like.

The touch sensor may be configured to convert changes of a pressure applied to a specific part of the display unit 151, or a capacitance occurring from a specific part of the display unit 151, into electric input signals. Also, the touch sensor may be configured to sense not only a touched position and a touched area, but also a touch pressure.

When touch inputs are sensed by the touch sensors, corresponding signals are transmitted to a touch controller (not shown). The touch controller processes the received signals, and then transmits corresponding data to the controller 180. Accordingly, the controller 180 may sense which region of the display unit 151 has been touched.

Referring to FIG. 1, a proximity sensor 141 may be arranged at an inner region of the portable terminal 100 covered by the touch screen, or near the touch screen. The proximity sensor may sense a presence or absence of an object approaching a surface to be sensed, or an object disposed near a surface to be sensed, by using an electromagnetic field or infrared rays without a mechanical contact. The proximity sensor has a longer lifespan and a more enhanced utility than a contact sensor.

The proximity sensor may include an optical transmission type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and so on. When the touch screen is implemented as a capacitance type, proximity of a pointer to the touch screen is sensed by changes of an electromagnetic field. In this case, the touch screen (touch sensor) may be categorized into a proximity sensor.

Hereinafter, for the sake of convenience of brief explanation, a status that the pointer is positioned to be proximate onto the touch screen without contact will be referred to as 'proximity touch', whereas a status that the pointer substantially comes in contact with the touch screen will be referred to as 'contact touch'. For the position corresponding to the proximity touch of the pointer on the touch screen, such position corresponds to a position where the pointer faces perpendicular to the touch screen upon the proximity touch of the pointer.

The proximity sensor senses proximity touch, and proximity touch patterns (e.g., distance, direction, speed, time, position, moving status, etc.). Information relating to the sensed proximity touch and the sensed proximity touch patterns may be output onto the touch screen.

The audio output module 152 may output audio data received from the wireless communication unit 110 or stored in the memory 160 in a call-receiving mode, a call-placing mode, a recording mode, a voice recognition mode, a broadcast reception mode, and the like. The audio output module 152 may output audio signals relating to functions performed in the mobile terminal 100, e.g., sound alarming a call received or a message received, and so on. The audio output module 152 may include a receiver, a speaker, a buzzer, and so on.

The alarm unit 153 outputs signals notifying occurrence of events from the mobile terminal 100. The events occurring from the mobile terminal 100 may include a call received, a message received, a key signal input, a touch input, and the like. The alarm unit 153 may output not only video or audio signals, but also other types of signals such as signals notifying occurrence of events in a vibration manner. Since the video or audio signals can be output through the display unit 151 or the audio output unit 152, the display unit 151 and the audio output module 152 may be categorized into a part of the alarm unit 153.

The haptic module 154 generates various tactile effects which a user can feel. A representative example of the tactile effects generated by the haptic module 154 includes vibration. Vibration generated by the haptic module 154 may have a controllable intensity, a controllable pattern, and so on. For instance, different vibration may be output in a synthesized manner or in a sequential manner.

The haptic module 154 may generate various tactile effects, including not only vibration, but also arrangement of pins vertically moving with respect to a skin being touched (contacted), air injection force or air suction force through an injection hole or a suction hole, touch by a skin surface, presence or absence of contact with an electrode, effects by stimulus such as an electrostatic force, reproduction of cold or hot feeling using a heat absorbing device or a heat emitting device, and the like.

The haptic module 154 may be configured to transmit tactile effects (signals) through a user's direct contact, or a user's muscular sense using a finger or a hand. The haptic module 154 may be implemented in two or more in number according to the configuration of the mobile terminal 100.

The memory 160 may store a program for the processing and control of the controller 180. Alternatively, the memory 160 may temporarily store input/output data (e.g., phonebook data, messages, still images, video and the like). Also, the memory 160 may store data related to various patterns of vibrations and audio output upon the touch input on the touch screen.

The memory 160 may be implemented using any type of suitable storage medium including a flash memory type, a hard disk type, a multimedia card micro type, a memory card type (e.g., SD or DX memory), Random Access Memory (RAM), Static Random Access Memory (SRAM), Read-Only Memory (ROM), Electrically Erasable Programmable Read-only Memory (EEPROM), Programmable Read-only Memory (PROM), magnetic memory, magnetic disk, optical disk, and the like. Also, the mobile terminal 100 may operate a web storage which performs the storage function of the memory 160 on the Internet.

The interface unit 170 may generally be implemented to interface the mobile terminal 100 with external devices. The interface unit 170 may allow a data reception from an external device, a power delivery to each component in the portable terminal 100, or a data transmission from the portable terminal 100 to an external device. The interface unit 170 may include, for example, wired/wireless headset ports, external charger ports, wired/wireless data ports, memory card ports, ports for coupling devices having an identification module, audio Input/Output (I/O) ports, video I/O ports, earphone ports, and the like.

The identification module may be configured as a chip for storing various information required to authenticate an authority to use the mobile terminal 100, which may include a User Identity Module (UIM), a Subscriber Identity Module (SIM), and the like. Also, the device having the identification module (hereinafter, referred to as 'identification device') may be implemented in a type of smart card. Hence, the identification device can be coupled to the mobile terminal 100 via a port.

Also, the interface unit 170 may serve as a path for power to be supplied from an external cradle to the mobile terminal 100 when the mobile terminal 100 is connected to the external cradle or as a path for transferring various command signals inputted from the cradle by a user to the mobile terminal 100. Such various command signals or power inputted from the cradle may operate as signals for recognizing that the mobile terminal 100 has accurately been mounted to the cradle.

The controller 180 typically controls the overall operations of the mobile terminal 100. For example, the controller 180 performs the control and processing associated with telephony calls, data communications, video calls, and the like. The controller 180 may include a multimedia module 181 which provides multimedia playback. The multimedia module 181 may be configured as part of the controller 180 or as a separate component.

The controller 180 can perform a pattern recognition processing so as to recognize writing or drawing input on the touch screen as text or image. The power supply unit 190 provides power required by various components under the control of the controller 180.

The provided power may be internal power, external power, or combination thereof.

Various embodiments described herein may be implemented in a computer-readable medium using, for example, software, hardware, or some combination thereof.

For a hardware implementation, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, micro processors, other electronic units designed to perform the functions described herein, or a selective combination thereof. In some cases, such embodiments are implemented by the controller 180.

For software implementation, the embodiments such as procedures and functions may be implemented together with separate software modules each of which performs at least one of functions and operations. The software codes can be implemented with a software application written in any suitable programming language. Also, the software codes may be stored in the memory 160 and executed by the controller 180.

Figure 2A:
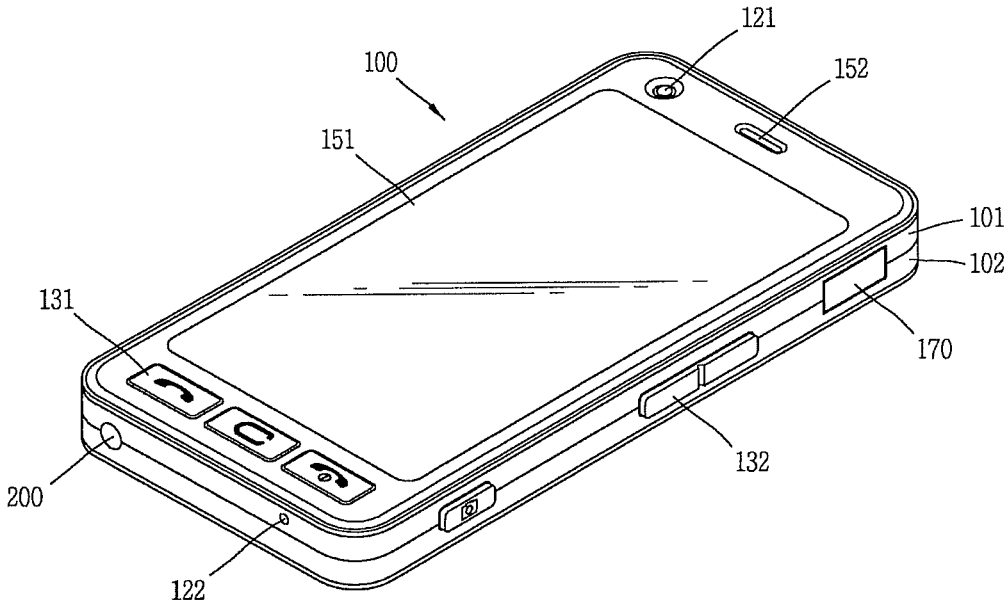
FIG. 2A is a front perspective view illustrating an example of a mobile terminal.

FIG. 2A is a front perspective view illustrating an example of a mobile terminal.

The mobile terminal 200 disclosed herein is provided with a bar-type terminal body. However, the present application is not limited to this type of terminal, but is also applicable to various structures of terminals such as slide type, folder type, swivel type, swing type, and the like, in which two or more bodies are combined with each other in a relatively movable manner.

A body may include a case (or referred to as casing, housing, cover, etc.) defining an appearance of the mobile terminal 100. In this exemplary embodiment, the case may be divided into a front case 101 and a rear case 102. A space formed between the front and rear cases 101 and 102 may accommodate various electronic components. At least one intermediate case may further be disposed between the front and the rear cases 101 and 102.

Such cases may be injected using a synthetic resin or be formed of a metal, such as stainless steel (STS), titanium (Ti) or the like.

The terminal body is shown having a display unit 151, an audio output module 152, a camera 121, a user input unit 130/131, 132, a microphone 122, an interface unit 170, and the like.

The display unit 151 may occupy most of a principal surface of the front case 101. The audio output module 152 and the camera 121 may be disposed near one of both end portions of the display unit 151, and the user input unit 131 and the microphone 122 near the other end portion of the display unit 151. The user input unit 131, the interface unit 170 and the like may be disposed on side surfaces of the front and rear cases 101 and 102.

The display unit 151 may display various types of visual information. Those information may be displayed in the form of characters, numbers, symbols, graphics, icons or the like.

For input of the information, at least one of characters, numbers, graphics or icons may be arranged and displayed in a preset configuration, thus being implemented in the form of a keypad. Such keypad may be called 'soft key.'

The display unit 151 may be operated as a single entire region or by being divided into a plurality of regions. For the latter, the plurality of regions may cooperate with one another.

The user input unit 130 is manipulated to receive a command for controlling the operation of the mobile terminal 100, and may include a plurality of manipulation units 131, 132. The manipulation units 131, 132 may be commonly designated as a manipulating portion, and any method may be employed if it is implemented in a tactile manner allowing the user to perform manipulation with a tactile feeling.

The contents inputted by the manipulation units 131, 132 may be set in various ways. For example, the first manipulation unit 131 may be used to receive a command, such as start, end, scroll, or the like, and the second manipulation unit 132 may be used to receive a command, such as controlling a volume level being outputted from the audio output unit 152, or switching it into a touch recognition mode of the display module 151.

Figure 2B:
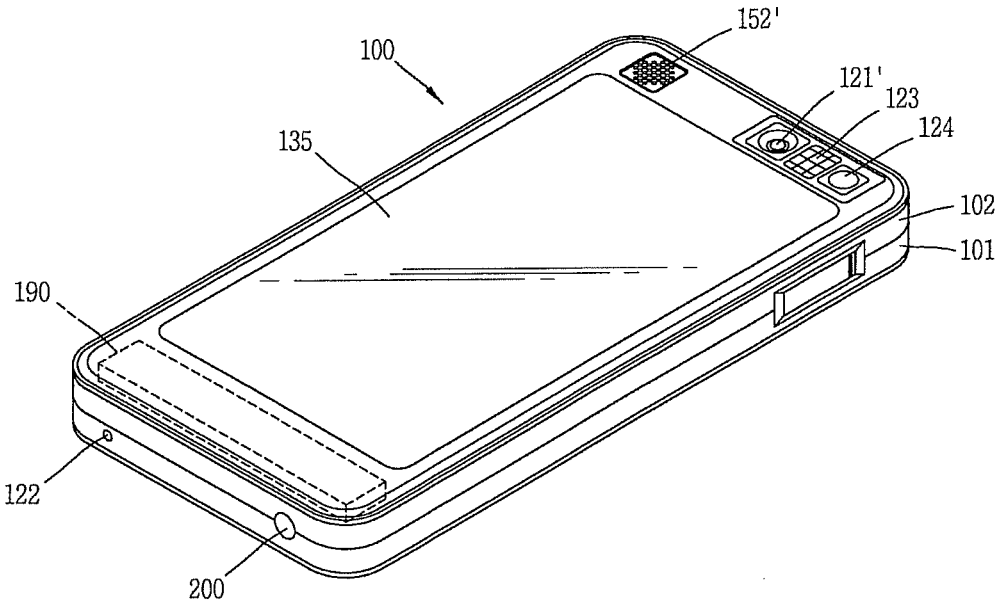
FIG. 2B is a rear perspective of the mobile terminal of FIG. 2A.

FIG. 2B is a rear perspective of the mobile terminal of FIG. 2A.

As shown in FIG. 2B, the rear case of the terminal body, namely, the rear case 102 may further be provided with a camera 121'. The camera 121' faces a direction which is opposite to a direction faced by the camera 121 (see FIG. 2A), and may have different pixels from those of the camera 121.

For example, the camera 121 may operate with relatively lower pixels (lower resolution). Thus, the camera 121 may be useful when a user can capture his face and send it to another party during a video call or the like. On the other hand, the camera 121' may operate with a relatively higher pixels (higher resolution) such that it can be useful for a user to obtain higher quality pictures for later use. The cameras 121 and 121' may be installed in the terminal body to be rotatable or popped up.

A flash 123 and a mirror 124 may additionally be disposed adjacent to the camera 121'. The flash 123 operates in conjunction with the camera 121' when taking a picture using the camera 121'. The mirror 124 can cooperate with the camera 121' to allow a user to photograph himself in a self-portrait mode.

An audio output module 152' may further be disposed at a rear face of the terminal body, namely, the rear case 102. The audio output module 152' can cooperate with the audio output module 152 (see FIG. 2A) to provide stereo output. Also, the audio output module 152' may be configured to operate as a speakerphone.

A power supply unit 190 for supplying power to the mobile terminal 100 may be mounted in the terminal body. The power supply unit 190 may be mounted in the terminal body or detachably coupled directly onto the outside of the terminal body.

The rear case 102 may be further provided with a touchpad 135 for detecting a touch input. Similar to the display module 210, the touchpad 135 may be implemented as a light-transmissive type. Here, if the display unit 151 is configured to output visual information from both surfaces, the visual information can be recognized through the touchpad 135. The information output from the both surfaces may all be controlled by the touchpad 135. Unlike to this, a display may further be mounted on the touchpad 135 so as to configure a touch screen even on the rear case 102.

The touchpad 135 may operate mutually in association with the display unit 151 of the front case 101. The touchpad 135 may be provided on the rear of the display unit 151 in parallel to each other. The touchpad 135 may have a size the same as or smaller than the size of the display unit 151.

As shown, at a side surface of the terminal body may be installed an antenna device 200 which is capable of being extended (extracted, unfolded, withdrawn) to the exterior. The antenna device 200 may be an antenna for receiving a broadcast signal in addition to an antenna for communication. That is, the antenna device 200 is an antenna configuring a part of the broadcast receiving module 111 (see FIG. 1), and may be extendible from the terminal body. Here, without the present disclosure being limited thereto, the antenna device 200 may be an antenna used for a different purpose, from the reception of the broadcast signal.

Figure 3:
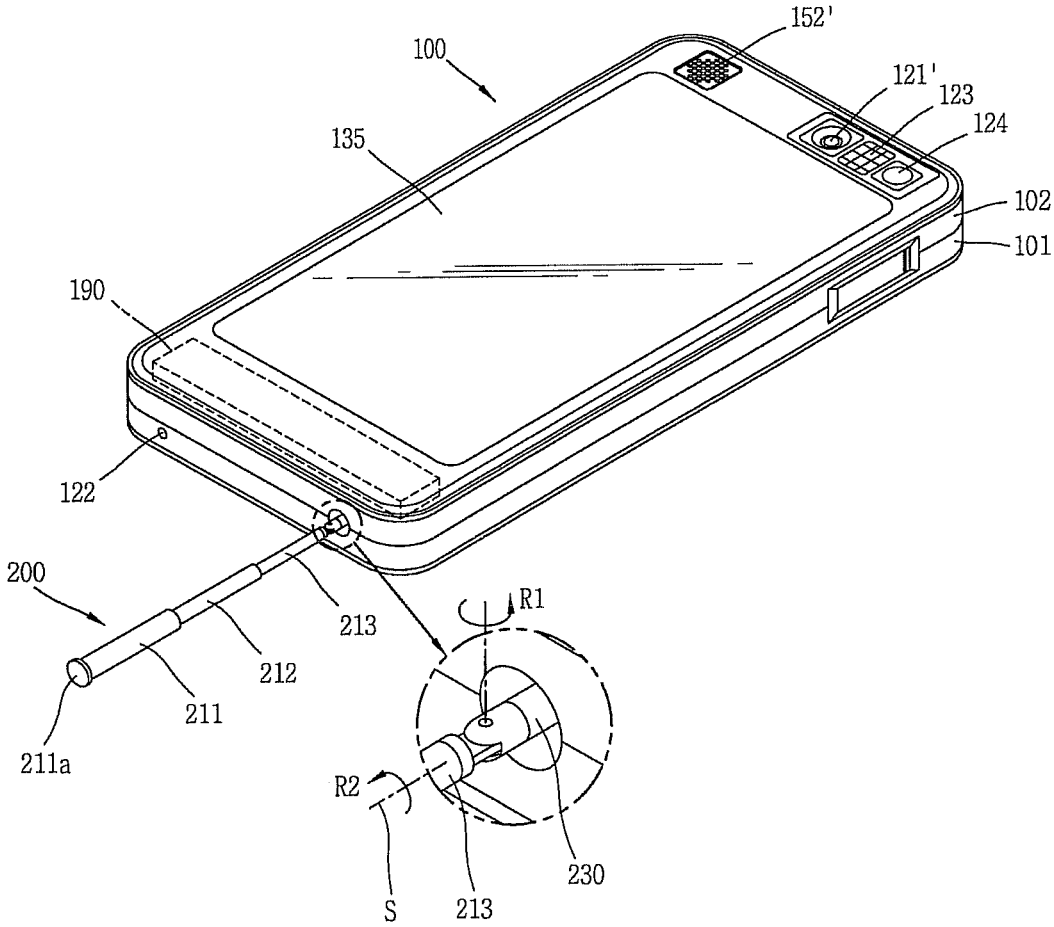
FIG. 3 is a perspective view of the mobile terminal with an antenna device of FIG. 2B unfolded.

FIG. 3 is a perspective view of the mobile terminal with the antenna device 200 of FIG. 2B unfolded.

As shown in FIG. 3, the antenna device 200 may include a plurality of electric conductors 211, 212 and 213 which have different diameters. One conductor (e.g., 211) may be capable of receiving the other conductors 212 and 213 therein. For example, the hollow conductors 21, 212 and 213 may be combined to form a stacked antenna.

Referring to FIG. 3, the conductor 213 whose diameter is the smallest among the hollow conductors 211, 212 and 213 may be rotatably connected to a post unit 230, which protrudes from the terminal body to support the conductors. As one example, the conductor 213 and the post unit 230 may be coupled to each other by a hinge. With the configuration, the stacked antenna may be rotatable (R1) based on the hinge-coupled portion.

The post unit 230 may be rotatable (R2) based on a central axis S, which thusly allows the stacked antenna to be rotatable together with the post unit 230.

Hereinafter, description will be given of a structure and an operation of the antenna device in more detail.

Figure 4:
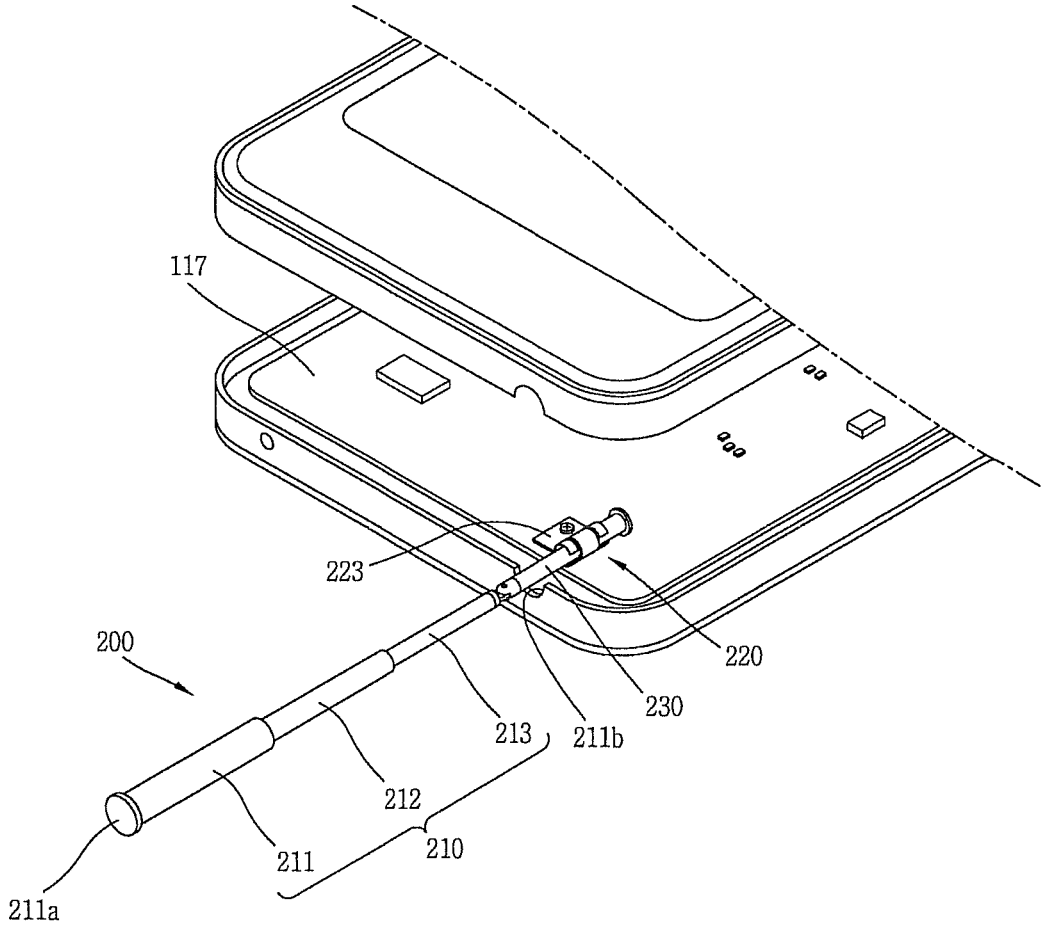
FIG. 4 is a disassembled perspective view of the mobile terminal of FIG. 3.
Figure 5:
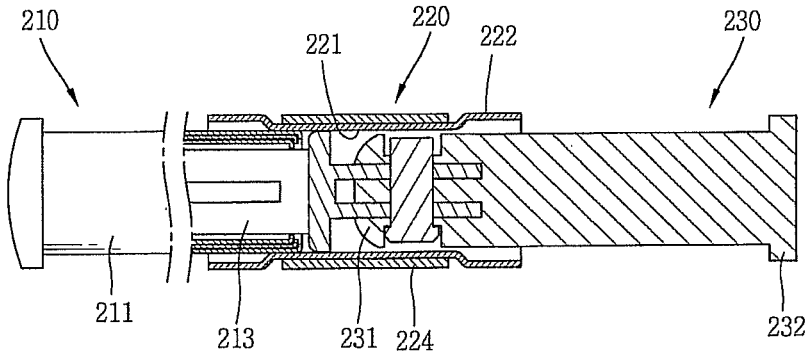
FIG. 5 is a sectional view of the antenna device of FIG. 3.

FIG. 4 is a disassembled perspective view of the mobile terminal of FIG. 3, FIG. 5 is a sectional view of the antenna device of FIG. 3, and FIGS. 6A to 6D are sectional views each showing an operation of the antenna device of FIG. 5.

As shown in FIG. 4, the rear case 102 may be shown having a circuit board 117 and the like.

The circuit board 117 may be configured as one example of the controller 180 (see FIG. 1) for controlling various functions of the mobile terminal. The circuit board 117 may process a signal (wireless (radio) signal) corresponding to a transmitted or received radio electromagnetic wave. Electronic devices, such as a speaker, a camera, a display and the like may be mounted on the circuit board 117.

The rear or front case 101, 102 may be shown having the antenna device 200 for transmission and reception of the wireless signal. The wireless signal may be transferred from the antenna device 200 to the circuit board 117 or from the circuit board 117 to the antenna device 200.

As shown in FIGS. 4 and 5, the antenna device may include an antenna unit 210, an elastic unit 220, and a post unit 230.

Referring to those drawings together with FIG. 3, the hollow conductors 211, 212 and 213 may form the antenna unit 210, which is extended (unfolded, extracted, or withdrawn) to the outside while being retracted in the terminal body. The antenna device 200 may be configured so that a length of an antenna can change again in a state that the hollow conductors 211, 212 and 213 are unfolded. This may allow for selective transmission and reception of radio signals at a multi-frequency band.

In more detail, the antenna unit 210 may be implemented as a module by combination of a housing extending in one direction, and a plurality of conductors 212 and 213 sequentially received (retracted) into the housing. That is, the conductors 212 and 213 may be retracted into the housing in an overlapping manner, or extracted out of the housing.

The housing corresponds to the outmost conductor of the stacked antenna, and may be the conductor 211 (hereinafter, referred to as 'housing') having the greatest diameter of the plurality of conductors 211, 212 and 213. More concretely, the antenna unit 210 may be a diameter-increasing antenna unit with the structure that its diameter gradually increases in an extending direction under an unfolded state.

A knob 211*a* that a user pinches when pulling the antenna unit 210 out may be disposed at an end of the housing 211. The terminal body may be provided with a receiving recess 211*b* in which the knob 211*a* is received.

The plurality of conductors 212 and 213 may include a connection conductor 213 and intermediate conductors 212.

The connection conductor 213 may be a conductor, which is received in the housing 211, connected to the post unit 230, and has the smallest diameter. The intermediate conductors 212 may be disposed between the connection conductor 213 and the housing 211 in the overlapping manner. Unlike to this, more intermediate conductors 212 may be provided.

The connection conductor 213 may be connected to a connecting portion 231 of the post unit 230. For example, the connecting portion 231 may be formed at one end of the post unit 230, and connected to the connection conductor 213 by a hinge (or a pivot).

The elastic unit 220 may include a hollow portion 221 through which the housing 211 moves, and apply an elastic force to the housing 211.

The elastic unit 220 may include a ring spring 222 and a coupling portion 223.

The ring spring 222 may press an outer circumference of the housing 211, and the coupling portion 223 may support the ring spring 222 and be coupled to the terminal body.

As one example, the ring spring 222 may have a C-ring shape, and the coupling portion 223 may extend from an outer circumference of the C-ring. The coupling portion 223 may include a screw hole for screw-coupling with the terminal body. Without the present disclosure being limited thereto, the coupling portion 223 may have a shape protruding from an outer circumference of an auxiliary ring spring 224.

The auxiliary ring spring 224 may cover the outer circumference of the ring spring 222 so as to increase an elastic force of the elastic unit 220. In addition, the auxiliary ring spring 224 may elastically directly press the housing 211. As one example of the auxiliary ring spring 224, a C-ring similar to the ring spring 222 may be employed.

Referring to FIGS. 6A to 6D together with FIG. 4 and FIG. 5, the post unit 230 may include a stopping portion 232 which is stopped at the elastic unit 220 when the post unit 230 is inserted into the hollow portion 221 of the elastic unit 220. The stopping portion 232 may be formed at an end of the post unit 230, which is opposite to the end of the post unit 230 where the connecting portion 231 is located.

The post unit 230 may be movable between a first position (e.g., a position shown in FIG. 6A) where the housing 211 is received in the hollow portion 221 and a second position (e.g., a position shown in FIG. 6D) where the stopping portion 232 is stopped at the elastic unit 220. The first position corresponds to a state that the antenna unit 210 is fully retracted in the terminal body, whereas the second position corresponds to a state that the antenna unit 210 is fully extracted to the outside of the terminal body.

The antenna device 200 may include an insertion guiding unit 240 formed at an outer circumferential surface of the post unit 230 such that at least part of before the stopping portion 232 is stopped at the elastic unit 220 along a direction of a central axis of the housing 211.

The insertion guiding unit 240 may be involved with all or part of the antenna unit 210, the elastic unit 220 and the post unit 230.

For example, the insertion guiding unit 240 may form a gap G (see FIG. 6B) between the post unit 230 and the elastic unit 220 such that at least a part of the post unit 230 can be inserted into the hollow portion 221 between the first and second positions. As one example, a diameter D3 of the post unit 230 may be smaller than a diameter D1 of the housing 211, and accordingly the insertion guiding unit 240 may guide the post unit 230 to be inserted into the elastic unit 220 while the housing 211 supports the elastic unit 220.

Figure 6A:
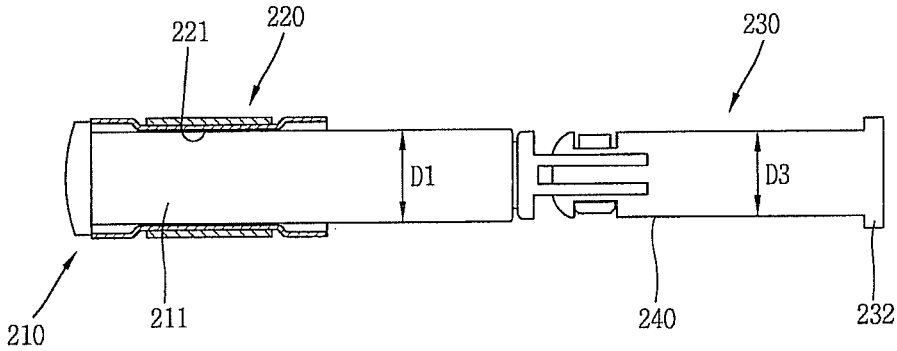
FIGS. 6A to 6D are sectional views each showing an operation of the antenna device of FIG. 5.
Figure 6B:
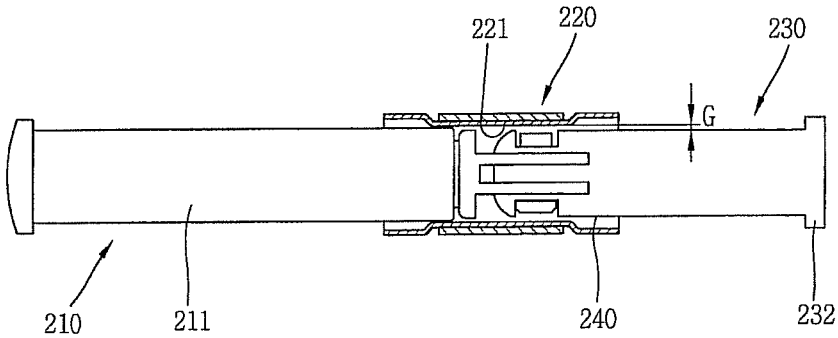

Referring to FIGS. 6A and 6B, when the housing 211 is pulled from the first position, the plurality of conductors 212 and 213 of the antenna unit 210 which were retracted within the housing 211 are extended out. The plurality of conductors 212 and 213 may be moved by a frictional force against each other, in response to the housing 211.

Referring to FIG. 6B, with the housing 211 incompletely escaping from the hollow portion 221, at least part of the post unit 230 may be inserted into the hollow portion 221. When at least part of the post unit 230 is inserted into the elastic unit 200, the insertion guiding unit 240 may reduce the frictional force therebetween. In addition, the existence of the gap G may prevent the contact between the post unit 230 and the elastic unit 220, and in this state, the frictional force may not be generated.

Figure 6C:
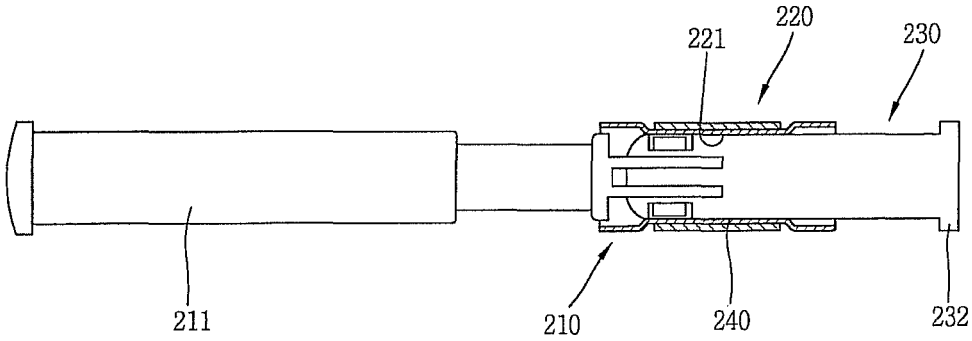

Referring to FIGS. 6B and 6C, when the housing 211 is further pulled out, the housing 211 may be completely moved out of the hollow portion 211 with at least part of the post unit 230 being inserted in the hollow portion 211.

The elastic unit 220 may apply an elastic force to the post unit 230 while the at least part of the post unit 230 is present within the hollow portion 211. In more detail, when the housing 211 is completely pulled out of the hollow portion 211, nothing supports the ring spring 222 or the auxiliary ring spring 224. Accordingly, the ring spring 222 or the auxiliary ring spring 224 may elastically transformed to press the outer circumference of the post unit 230. The elastic unit 220 may thusly grip the post unit 230.

Referring to FIG. 6C, when the housing 211 is further pulled out, the conductors 212 and 213 may be unfolded (extended) to the outside of the terminal body with the elastic unit 220 applying the elastic force to the post unit 230. Here, the post unit 230 may be temporarily secured by the pressing of the elastic unit 220. To this end, the frictional force between the post unit 230 and the elastic unit 220 may be greater than a frictional force among the conductors 211, 212 and 213.

Figure 6D:
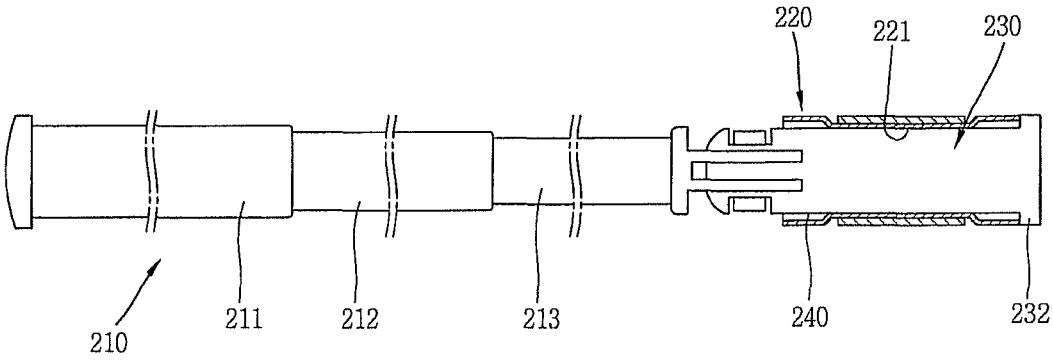

Referring to FIGS. 6C and 6D, after the antenna unit 210 is extended, the post unit 230 is further moved such that the stopping portion 232 can be stopped at the elastic unit 220, accordingly, the post unit 230 is secured.

According to the mechanism, upon performing an operation of unfolding (extending) the diameter-increasing antenna unit, the antenna unit may be prevented from being shaken or trembled and loosed. Hereinafter, description will be given of variations of the one exemplary embodiment or other exemplary embodiments according to this specification. For the sake of brief description of the variations or other exemplary embodiments, the same or equivalent components will be provided with the same reference numbers as those in the previous exemplary embodiment, and description thereof will not be repeated.

Figure 7A:
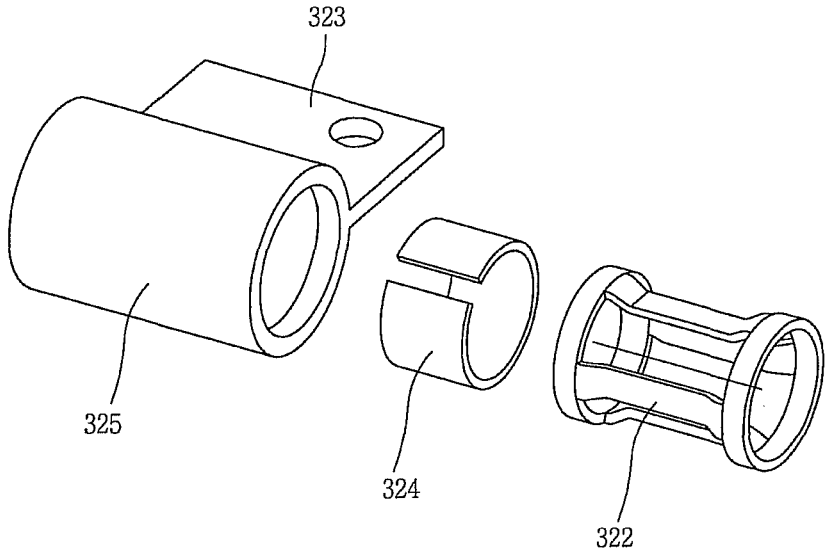
FIGS. 7A and 7B are a disassembled view and a sectional view showing a variation of an antenna device according to this specification.
Figure 7B:
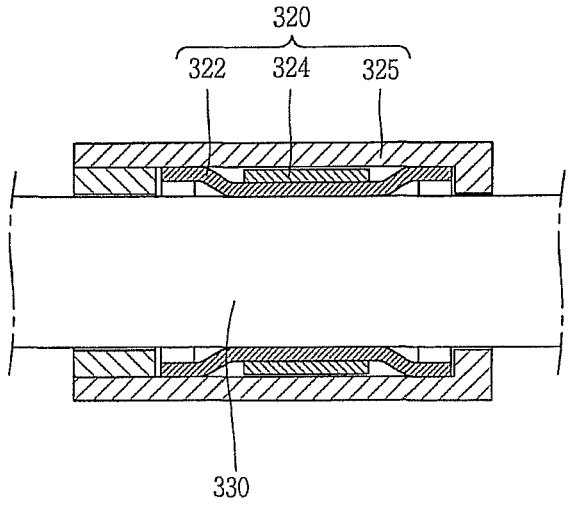

FIGS. 7A and 7B are a disassembled view and a sectional view, respectively, showing a variation of an antenna device according to this specification.

As shown in FIGS. 7A and 7B, a coupling portion 323 for coupling an elastic unit 320 to the terminal body may extend from a casing 325, which covers a ring spring 322 and an auxiliary ring spring 324.

For example, the auxiliary ring spring 324 may cover an outer circumference of the ring spring 322. They may then be received in the casing 325. The casing 325 may include a hollow body through which an antenna unit moves, and a coupling portion may protrude from an outer circumference of the hollow body. The casing 325 may be formed of a metal, for example, fabricated by die-casting.

The antenna device according to this variation may be advantageous of being utilized as a type of antenna device which protects a post unit 330.

Figure 8A:
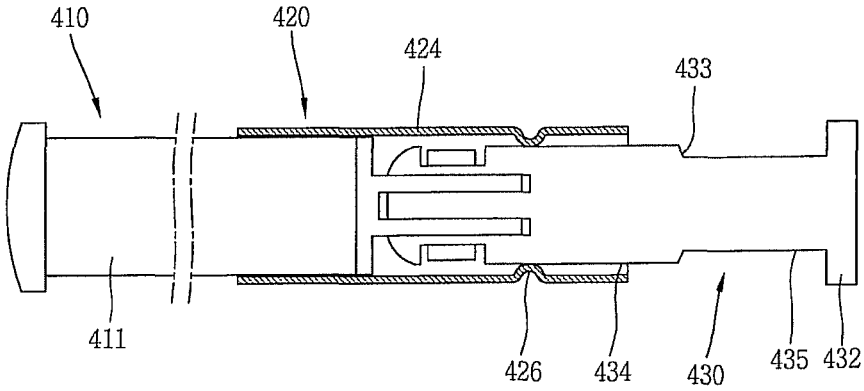
FIGS. 8A and 8B are sectional views each showing an operation of an antenna device in accordance with another exemplary embodiment.
Figure 8B:
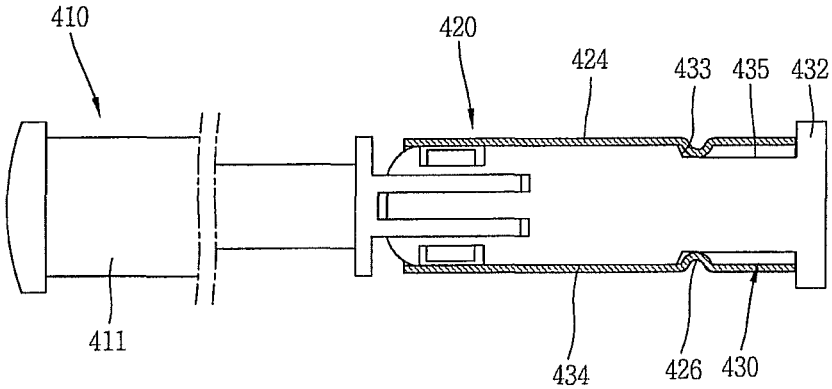

FIGS. 8A and 8B are sectional views each showing an operation of an antenna device in accordance with another exemplary embodiment.

As shown in FIGS. 8A and 8B, a ring spring 424 may include a circumferential protrusion 426 protruding toward a post unit 430. At an outer circumferential surface of the post unit 430 may be formed a stepped portion 433 by which the post unit 430 can be stopped at the circumferential protrusion 426 as its diameter is reduced.

More concretely, the circumferential protrusion 426 may be formed in a circumferential direction of the ring spring 424 and have a shape protruding toward the inside of the ring spring 424. Also, when the post unit 430 is divided into first and second diameter portions 434 and 435, the stepped portion 433 may be a stepped surface which is generated at a boundary between the first and second diameter portions 434 and 435.

Here, a stopping portion 432 may be formed to restrict the movement of the post unit 430 in an opposite direction to a direction that the stepped portion 433 restricts the movement of the post unit 430. For example, as shown in FIG. 8A, in a state that a housing 411 is incompletely pulled out of an elastic unit 420, the first diameter portion 434 of the post unit 430 is inserted into the elastic unit 420, and at this time, the circumferential protrusion 426 is disposed to be located (face) the first diameter portion 434.

When the housing 411 completely escapes from the elastic unit 420, the circumferential protrusion 426 may press the first diameter portion 434 so as to grip the post unit 430. As shown in FIG. 8B, after the antenna unit 410 is unfolded, the post unit 430 may then be moved and the circumferential protrusion 426 may be inserted onto the second diameter portion 435. With this structure, even if a force is applied to push the antenna unit 410 in the state that the antenna unit 410 is unfolded, the post unit 430 may be secured until before the conductors of the antenna unit 410 are retracted into the housing 411.

FIGS. 9A to 9D are sectional views each showing an operation of an antenna device in accordance with another exemplary embodiments.

Figure 9A:
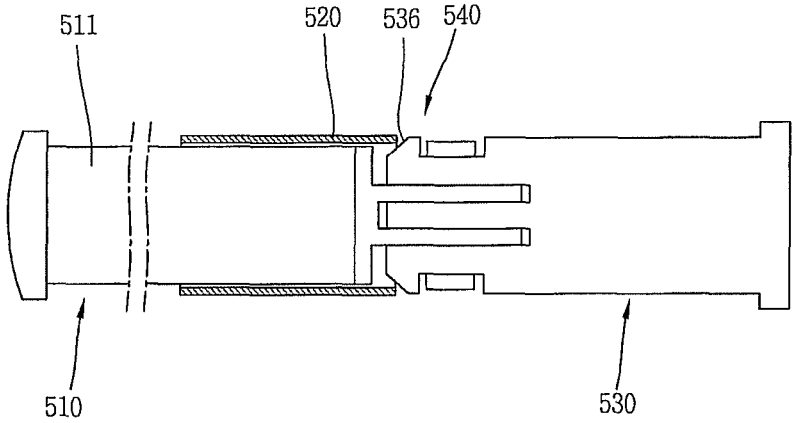
FIGS. 9A to 9D are sectional views each showing an operation of an antenna device in accordance with another exemplary embodiments.

Referring to FIG. 9A, an insertion guiding unit 540 may include a tilt portion 536 inclined at one end of a post unit 530 to gradually increase the contact between the post unit 530 and an elastic unit 520. Here, a diameter of the post unit 530 may be the same as or greater than that of a housing 511.

When the housing 511 is pulled out, an end portion of the elastic unit 520 becomes wider along the tilt portion 536 of the post unit 530, which may allow the post unit 530 to be smoothly inserted into the elastic unit 520 before the housing 511 escapes from the elastic unit 520.

Figure 9B:
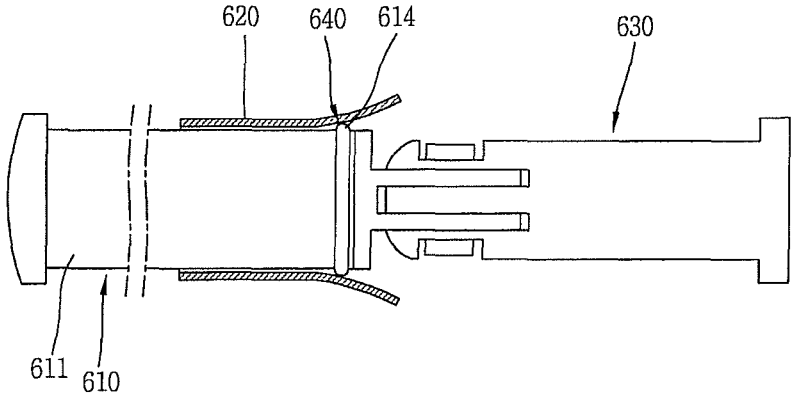

Referring to FIG. 9B, at one end portion of a housing 611 may be formed a housing protrusion 614 such that a diameter of a portion of an elastic unit 620, which is adjacent to an opening of a hollow portion, can be increased when at least part of the elastic unit 620 is moved out of the housing 611.

The housing protrusion 614 may be formed along a circumference of the housing 611. When a diameter of the post unit 630 is the same as or greater than that of the housing 611, the housing protrusion 614 may serve to widen the elastic unit 620 when the post unit 630 is inserted into the elastic unit 620.

Figure 9C:
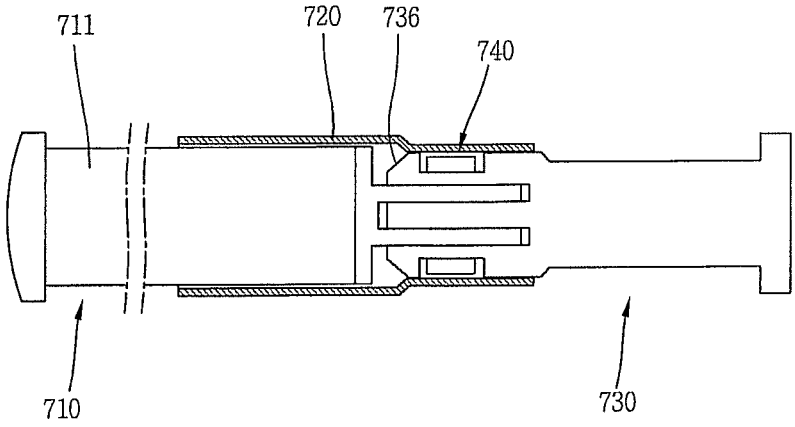

Referring to FIG. 9C, an elastic unit 720 may be formed such that a portion thereof, which is close to the post unit 730, can have a more reduced diameter than a diameter of a portion away from the post unit 730. For example, the elastic unit 720 may be a spring having Z-shaped section.

An insertion guiding unit 740 may have a diameter smaller than that of a housing 711. A post unit 730 may have a stepped portion. With this structure, when the post unit 730 is completely inserted into the elastic unit 720, they are engaged with each other, thereby implementing more stable gripping.

Figure 9D:
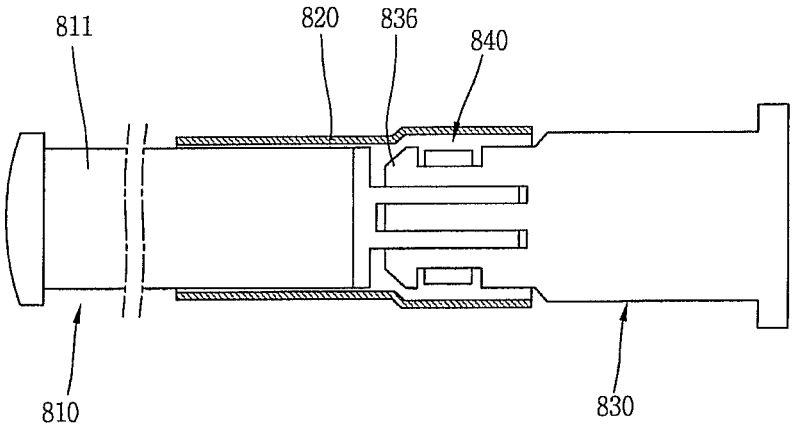

Referring to FIG. 9D, an elastic unit 820 and a post unit 830 may be stepped by each other in an opposite direction that the elastic unit 720 and the post unit 730 are stepped by each other. That is, the elastic unit 820 may have a reverse Z-shaped section, and the post unit 830 may have a structure with a step-shaped section. With this structure, when the post unit 830 is fully inserted into the elastic unit 820, both the post unit 830 and the elastic unit 820 may be engaged with each other, and also a spaced distance may be more guaranteed when the elastic unit 820 is inserted into an insertion guiding unit 840.

Figure 10:
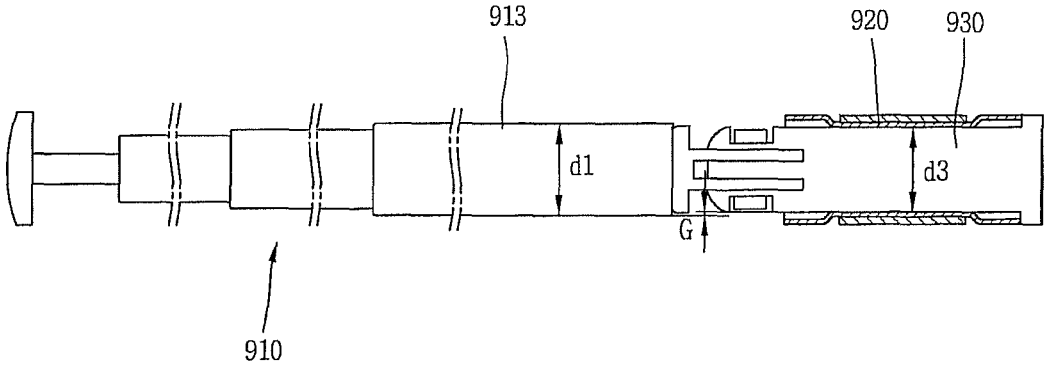
FIG. 10 is a sectional view showing an antenna device in accordance with another exemplary embodiment.

FIG. 10 is a sectional view showing an antenna device in accordance with another exemplary embodiment.

This exemplary embodiment illustrates a diameter-decreasing antenna device whose antenna unit 910 is gradually reduced in an extending direction. Even in this case, as the antenna unit 910 extends, the post unit 930 moves. In order for the post unit 930 to be smoothly inserted into an elastic unit 920, a diameter d3 of at least part of the post unit 930 may be smaller than a diameter d1 of a conductor 913. The diameter d1 of the conductor 913 may be the greatest diameter of those of conductors of the antenna unit 910.

According to the structure, before the conductor 913 having the greatest diameter is fully extended out of the elastic unit 920, the post unit 930 may be smoothly inserted into the elastic unit 920. Afterwards, when the conductor 913 having the greatest diameter completely escapes from the elastic unit 920, an inner diameter of the elastic unit may be reduced so as to press the post unit. Hence, the antenna unit 910 may rarely be shaken (or loosed) when being completely extended or while being extended.

A mobile terminal according to at least one of the exemplary embodiments having the configurations may employ an insertion guiding unit so as to prevent the antenna unit from being shaken or loosed while a diameter-increasing antenna unit is extended.

Also, this specification may implement a temporary securing mechanism for a diameter-increasing antenna unit between a position before being extended and a position after being extended by virtue of an insertion guiding unit.

In addition, this specification may employ a structure of gripping the post unit at both sides thereof, thereby improving reliability of an electric connection of the antenna.

The foregoing embodiments and advantages of the antenna device and a mobile terminal having the same are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mobile terminal comprising:

a terminal body; and an antenna device mounted at the terminal body, wherein the antenna device comprises:

an antenna unit having a housing extending in one direction, and a plurality of conductors sequentially retracted into the housing;

an elastic unit having a hollow portion through which the housing moves, the elastic unit applying an elastic force to the housing;

a post unit having a connecting portion connected with the antenna unit, and a stopping portion stopped at the elastic unit when being inserted into the hollow portion; and an insertion guiding unit formed at an outer circumferential surface of the post unit so that at least part of the post unit is inserted into the hollow portion before the stopping portion is stopped at the elastic unit in the one direction.

2. The terminal of claim 1, wherein the post unit moves between a first position where the housing is received in the hollow portion and a second position where the stopping portion is stopped at the elastic unit.

3. The terminal of claim 2, wherein the insertion guiding unit forms a gap between the post unit and the elastic unit such that at least part of the post unit is inserted into the hollow portion between the first and second positions.

4. The terminal of claim 3, wherein the elastic unit applies an elastic force to the post unit while the at least part of the post unit is inserted in the hollow portion.

5. The terminal of claim 4, wherein when the housing is pulled out, the conductors are unfolded out of the terminal body while the elastic unit applies the elastic force to the post unit.

6. The terminal of claim 2, wherein when the housing is pulled out from the first position, the antenna unit is extended with the plurality of conductors being retracted in the housing.

7. The terminal of claim 1, wherein when the housing is pulled out, the at least part of the post unit is moved out of the hollow portion while being inserted in the hollow portion.

8. The terminal of claim 1, wherein the plurality of conductors comprise:

a connection conductor received in the housing and connected to the post unit; and intermediate conductors arranged between the connection conductor and the housing in an overlapping manner.

9. The terminal of claim 1, wherein the elastic unit comprises:

a ring spring to press an outer circumference of the housing; and a coupling portion to support the ring spring, the coupling portion coupled to the terminal body.

10. The terminal of claim 9, wherein the ring spring is provided with a circumferential protrusion protruding toward the post unit, wherein a stepped portion is formed at an outer circumferential surface of the post unit, the stopped portion being stopped at the circumferential protrusion as a diameter of the post unit is reduced.

11. The terminal of claim 10, wherein the stopping portion restricts a movement of the post unit in an opposite direction to the stepped portion restricting the movement of the post unit.

12. The terminal of claim 9, wherein the elastic unit further comprises an auxiliary ring spring to cover an outer circumference of the ring spring so as to increase an elastic force of the elastic unit.

13. The terminal of claim 12, wherein the coupling portion extends from one of the ring spring and the auxiliary ring spring, or extends from a casing for covering the ring spring and the auxiliary ring spring.

14. The terminal of claim 1, wherein the insertion guiding unit guides the post unit to be inserted into the elastic unit while the housing supports the elastic unit, by virtue of a structure that the post unit has a diameter smaller than that of the housing.

15. The terminal of claim 14, wherein the insertion guiding unit comprises a tilt portion inclined at one end of the post unit to gradually increase a contact between the post unit and the elastic unit.

16. The terminal of claim 1, wherein a housing protrusion is formed at an end of the housing so as to increase a diameter of a portion of the elastic unit, adjacent to an opening of the hollow portion, when at least part of the elastic unit escapes out of the housing.

17. The terminal of claim 1, wherein the coupling portion and the stopping portion are arranged at both ends of the post unit, and the coupling portion is connected by a hinge to a conductor having the smallest diameter of the plurality of conductors.

18. A mobile terminal comprising:

a terminal body; and an antenna device mounted in the terminal body to transmit and receive a wireless signal, wherein the antenna device comprises:

an antenna unit having a housing extending in one direction, and a plurality of hollow conductors retracted in the housing in an overlapping manner or extending out of the housing;

an elastic unit mounted onto the terminal body and configured to apply an elastic force to the housing; and a post unit connected to one of the conductors to be movable together with the housing, the post unit being secured by being pressed by the elastic unit when the conductors are extended, wherein the post unit is configured such that at least part thereof is inserted into the elastic unit before the housing escapes from the elastic unit, a frictional force between the post unit and the elastic unit being greater than that between the conductors.

19. The terminal of claim 18, further comprising an insertion guiding unit configured to reduce a frictional force between the post unit and the elastic unit when at least part of the post unit is inserted into the elastic unit.

20. The terminal of claim 19, wherein the insertion guiding unit guides the post unit to be inserted into the elastic unit while the housing supports the elastic unit, by virtue of a structure that the post unit has a diameter smaller than that of the housing.

* * * * *